US006377697B1

(12) United States Patent
Cheng

(10) Patent No.: US 6,377,697 B1
(45) Date of Patent: Apr. 23, 2002

(54) EAR-MOUNTED HEADSET DEVICE

(76) Inventor: Ziyi Cheng, No. 501 Unit, Building 4, Fenghe Dong Yuan Baidi Road, Nankai District, Tianjing (CN)

( * ) Notice: Subject to any disclaimer, the term of this patent is extended or adjusted under 35 U.S.C. 154(b) by 0 days.

(21) Appl. No.: 09/485,315

(22) PCT Filed: Jul. 28, 1998

(86) PCT No.: PCT/CN98/00136

§ 371 Date: Feb. 3, 2000

§ 102(e) Date: Feb. 3, 2000

(87) PCT Pub. No.: WO99/08477

PCT Pub. Date: Feb. 18, 1999

(30) Foreign Application Priority Data

Aug. 5, 1997 (CN) ..... 97116626 A

(51) Int. Cl.[7] ..... H04R 25/00

(52) U.S. Cl. ..... 381/381; 381/330; 381/385; 381/390; 181/129; 379/430

(58) Field of Search ..... 381/182, 327, 381/330, 375, 379, 381, 385, 386, 390; 181/129, 199; 379/430

(56) References Cited

U.S. PATENT DOCUMENTS 5,210,792 A * 5/1993 Kajihara ..... 379/430
5,450,496 A * 9/1995 Burris et al. ..... 381/375
5,708,724 A * 1/1998 Burris et al. ..... 381/375
5,960,094 A * 9/1999 Jensen et al. ..... 381/381
6,101,260 A * 8/2000 Jensen et al. ..... 381/381

* cited by examiner

*Primary Examiner*—Sinh Tran
*Assistant Examiner*—P. Dabney
(74) *Attorney, Agent, or Firm*—J.C. Patents

(57) ABSTRACT

The invention relates to a ear transceiver comprising: an ear hanger, a transceiver mounted on another end of front stand of an ear hanger, and an electrical connection connected to the transceiver; the ear hanger is provided with: a front stand, a rear stand and a supporting tube connected to the front stand and rear stand, another end of the front stand connected to a microphone supporting rod, both ends of the microphone are connected to a microphone and an earphone respectively, the front stand has a plurality of supporting rods, a pair of connecting pieces are provided between various supporting rods and between the microphone supporting rod and end of the front stand, and the connecting part of the microphone supporting rod and earphone has plug-in pieces of electric connection. The ear hanger adapts to various sizes of human ears, both left and right ears can wear the same hanger, and the distance and height between the microphone and a mouth being adjustable and convenient in replacement.

10 Claims, 9 Drawing Sheets

EAR-MOUNTED HEADSET DEVICE

FIELD OF THE INVENTION

The invention relates to an ear transceiver, more particularly to an ear transceiver having an adjustable ear hanger, being wearable for both left and right ears.

BACKGROUND OF THE INVENTION

The hanger of existing ear transceiver have the defects of being large-size inconvenient in using and placing, and apt to ruffle the hair. Although the hanger length of existing ear transceiver on the back of the ears can be adjusted according to the size of the ear, the hanger size in front of the ear cannot be adjusted in accordance with the sizes of the ears, often resulting in drop of the earphone from ears. Moreover, existing ear hangers are not suitable for both left and right ears, and they are inconvenient in terms of adjusting the heights of and distance between the microphone and user's mouth.

SUMMARY OF THE INVENTION

The invention is aimed at solving the above problems. Therefore an object of the invention is to provide ear transceiver which is adapted for different sizes of human ears, wearable for both left and right ears, adjustable in heights of and distance between the microphone and user's mouth, and convenient in replacement of earphone and microphone cord.

To realize the above object, the ear transceiver of the present invention comprises:

- an ear hanger for hanging a transceiver on the ear(s) of a user; the ear hanger comprises a front stand, a rear stand, and a supporting tube connecting said front and rear stands; said front stand has a supporting rod, preferably has a plurality of supporting rods, and movable assembly connecting means is provided for each supporting rod; the supporting rod(s) is(are) so arranged that they allow the transceiver connected with the ear hanger to move and swing with respect to the ear hanger, so that the hanger can be suitable for both right and left ears; a braking device is employed between the front and rear stands and the supporting tube, allowing the stands to be movable relative to the supporting tube and locked after regulation to accommodate for the ears of different users;
- a transceiver mounted on one end of front stand of the ear hanger;
- an electrical connecting means connected to the transceiver.

Said transceiver comprises a microphone and an earphone.

Preferably, the movable assembly connecting means of the stands are hinges, which are positioned between a rear supporting rod of the microphone and a first supporting rod of the front stand, and between the first supporting rod and a second supporting rod of the front stand. The connecting directions of the two hinges are mutually parallel.

Preferably, hinges are provided between a rear supporting rod of the microphone and a first supporting rod of the front stand, between the first and a second supporting rods of the front stand, and between the second and a third supporting rods of the front stand. The connecting direction of the hinge connecting second and third supporting rods is perpendicular to the connecting directions of the two other hinges.

The front stand and the supporting tube have a sliding connecting means and a braking device.

Preferably, the sliding connecting means and the braking device are provided near the ends of the front stand and the rear stand where they are in movable contact with the inner walls at both ends of the supporting tube, respectively. Preferably, an opening and a corrugated spring reed are provided near both ends of the supporting tube. The corrugated spring reed is engaged with a serrate edge formed on the front stand and/or the rear stand.

Preferably, the electrical connecting means is a plug-in member, which comprises a plug-in unit and a socket assembly. The plug-in unit has a plug, a plug base, and a plug fastener. The socket assembly comprises a socket sleeve, a connector, a socket base, and a socket. The plug-in unit and socket assembly are provided at the joint region of a rear supporting rod of the microphone and an earphone casing. The front end of the plug has a plurality of pins, which are connected with a socket. The socket sleeve and the socket base have a connector to connect the two.

At the central part of the plug-in pieces, an earphone, microphone lead wire, and a plug supporting rod connected to an ear hanger are provided.

Since the invention provides a front stand having supporting rods with a plurality for hinge-joint (axial connectors), said microphone stand is hinge-jointed (axial connected) with the end of front stand, and the interconnecting piece of the microphone supporting rod and earphone has a rotatable plug-in piece for electrical connection of a microphone and an earphone, therefore it is suitable for the ears of different sizes of adults and children. Since a hinge structure is provided, the earphone direction is rotatable, therefore a same ear hanger is suitable for wearing on left and right ears. To this end the invention provideds a design of a replaceable plug-in piece of earphone and microphone cord. Said plug-in piece is rotatable up and down and matches with the ear hanger.

OPTIMUM REALIZATION MODE OF THE INVENTION

Below an embodiment of the invention is described in detail with reference to the drawings.

Figure 1:
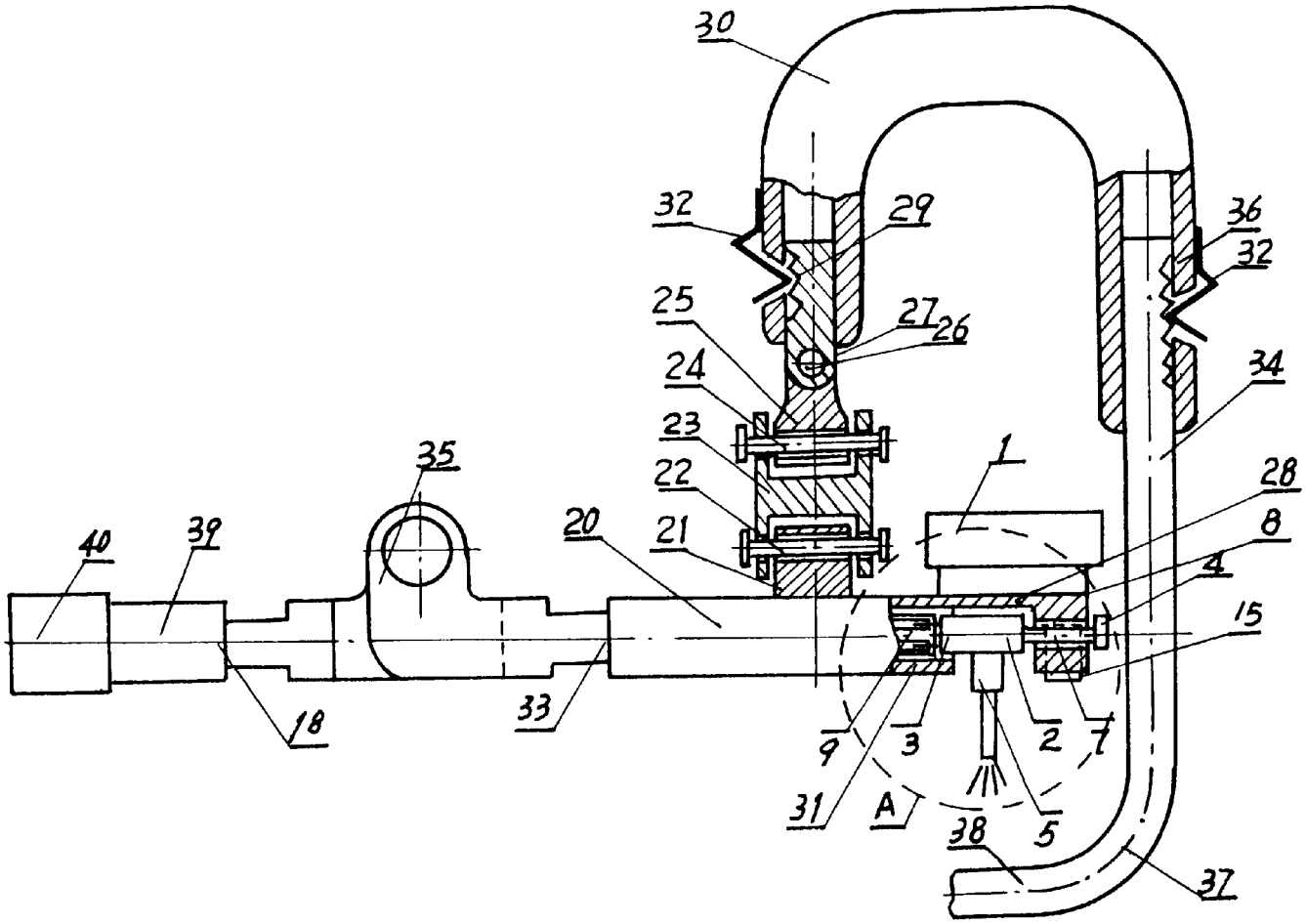
FIG. 1 is a structural part sectioned view of an embodiment of ear transceiver in the invention.
Figure 2:
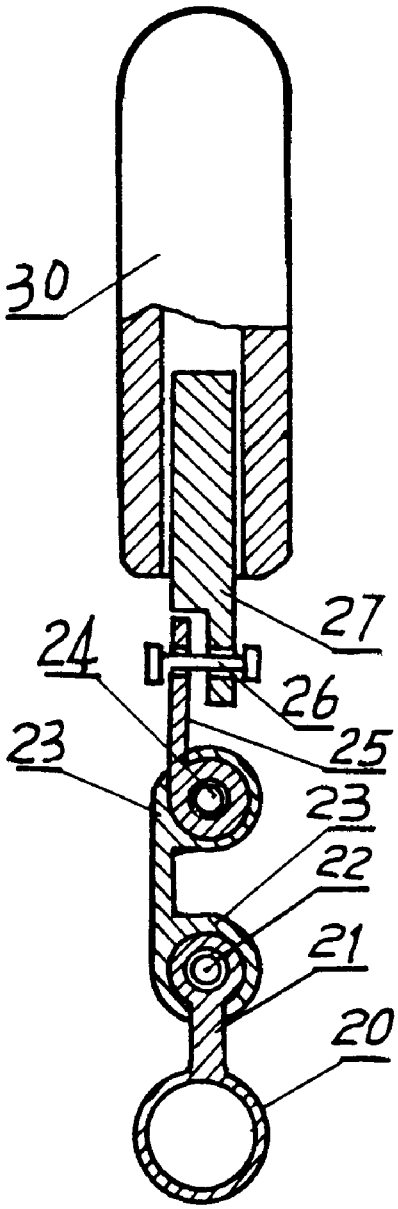
FIG. 2 is a left part sectioned view of an embodiment of a from stand of ear hanger in the invention shown in FIG. 1.

FIG. 1 is a partial sectional view of the structure of an embodiment of the ear transceiver of the invention; FIG. 2 is a left partial sectional view of the left front stand of the ear hanger shown in FIG. 1. As shown in the drawings, the ear transceiver comprises an ear hanger, a microphone and an earphone connected at both ends of a microphone connecting rod, and an earphone microphone wire plug-in piece.

In an earphone casing 1, an earphone and a circuit are provided. Connections between rear supporting rod 20 of the microphone 40 and an ear hanger and the connections among stands of the ear hanger are realized by using a movable assembly connecting means (see "Manual of Modern Mechanism" (Vol. I, II), (MENG Xianyuan et al ed. China Machine Press, June, 1994)). A branching supporting rod 21 connecting with the ear hanger is connected with the rear supporting rod 20 of the microphone. A connecting hole is provided on the branching supporting rod 21. A first axle 22 penetrates through the connecting hole on the branching supporting rod 21 and connecting holes on two connecting pieces on a first supporting rod 23 of front stand of the ear hanger, so as to form a rotatable hinge (i.e. a axle-sleeve structure) connection between the branching supporting rod 21 and the first supporting rod 23. The connecting position between the branching supporting rod 21 and the first supporting rod 23 of the front stand can be inverted. Thus, a structure is constructed between the two, in which the first supporting rod 23 of the front stand can rotate upward/downward for approximately 180° about the rear supporting rod 20 of the microphone so that the ear hanger allows the earphone to be wearable on both left and right ears. On the other end of the first supporting rod 23, there are two connecting holes and two connecting pieces, each of the connecting piece having one connecting hole formed thereon. Preferably, the connecting hole on the other end of the first supporting rod 23 is about 2–20 mm away from the first connecting axle 22 as measured from the center axis of the connecting holes to the center axis of the first connecting axle 22 Preferably, the connecting holes on the other end of the first supporting rod 23 extend in parallel with the branching supporting rod 21 and also in parallel with the rear supporting rod 20 of the microphone. A second axle 24 goes through the two connecting hole on the other end of the first supporting rod 23 to connect with a connecting hole on a second supporting rod 25 of the front stand of the ear hanger. A rotatable hinge structure (i.e. an axle-sleeve structure) is thus formed. In this way, the front stand of the ear hanger is allowed to rotate with a larger degree of freedom. If it is not necessary to increase the rotating angle of the front stand, the second supporting rod 25 can be omitted. Similarly, the connecting position between the first supporting rod 23 and the second supporting rod 25 can be inverted. In other words, the second supporting rod 25 may have two connecting pieces at the end connecting with the first supporting rod 23, while the first supporting rod 23 has only one connecting piece at this end. Moreover, if it is not required that the same earphone is wearable on both ears, the first axle 22 can also be omitted, and a fixed connection can be made. The distance between the branching supporting rod 21 and a nearest edge of the earphone casing 1 is within the range of 2–20 mm, therefore, a ledge on the front edge of auricle can be put between the branching supporting rod 21 and the earphone casing 1. On the other end of second supporting rod 25, a third axle 26 substantially perpendicular to the axial direction of the rear supporting rod 20 is provided. The second supporting rod 25 is connected to an end of a third supporting rod 27 via the third axle 26, and a rotatable hinge, i.e. an axle-sleeve structure, is formed between the two. Thus the rear supporting rod 20 of the microphone can perform back and forth rotation around the first axle 22, the second axle 24, and the third axle 26. Other movable assembly connecting means can also be utilized: e.g. spherical assembly formed by sphere and ball socket, connecting means with a central cross-shaped member, and other cylindrical assembly and axle-sleeve connecting means etc; and it can be a connecting means conducting rotation of one degree of freedom rotation or a multiple degrees of freedom.

Moreover, a sliding connecting means and a braking device are employed for the connection of third supporting rod 27 and a supporting tube 30. The other end of third supporting rod 27 is inserted into one end of supporting tube 30, forming a telescopic sliding connecting structure. Other sliding connecting means can also be used, e.g. those which connect in a sliding manner the outside of one end of supporting tube 30 with the other end of the third supporting rod 27. The supporting tube 30 can be circular, rectangular or of other various shapes. To keep the protrusion and retraction of this sliding connecting means to be relatively fixed, a braking device is provided at this end of the third supporting rod 27. For example, a serrate edge 29 is formed at the end of thethird supporting rod 27 inserted into the cavity of the supporting tube 30, and an opening and a corrugated spring reed 32 are provided near the end of supporting tube 30 to exert pressure on the serrate edge 29. Other braking devices can also be used, e.g. expansion or briquette brake performing elastic compression via an elastic member such as a helical spring or spring reed, a spring compressed friction brake, and a latch spring bolt brake etc.

Moreover, the supporting tube 30 is preferably made in an inverted U-shape. By using the sliding connecting means and braking devices similar to that used for the supporting tube 30 and the third supporting rod 27, one end of a rear stand 34 of the ear hanger is inserted into the cavity on the other end of supporting tube 30, forming a mutually retractable sliding connecting structure between them. To keep the extension/retraction of sliding connecting means relatively fixed, a braking device is provided at the end of rear stand 34. For example, a serrate edge 36 is formed in the portion of the rear stand 34 to be inserted into supporting tube 30, and an opening and a corrugated spring reed 32 are arranged near the rear end of supporting tube 30 to be elastically pressed on serrate edge 36. Other types of sliding connecting means and braking devices can also be used. Thus, by adjusting the depth of insertion between third supporting rod 27 of front stand and supporting tube 30 and between rear stand 34 and supporting tube 30, a front end 38 and a curved portion 37 of rear stand 34 are allowed to be pressed on the lower end of ear gristle with suitable degree of tightness.

The degree of bending of lower curved portion 37 of rear stand 34 of the ear hanger is determined according to the degree of bending of lower edge of ear gristle at the back of the ear. Similarly, the length of front end 38 of portion 37 can also be determined according to the lower edge of the ear gristle and the distance of the lower edge.

Although a simple microphone supporting rod is an integral piece with its one end being connected with a microphone and its other end being connected with an earphone, the microphone supporting rod can be divided into a plurality of interconnected sections. The microphone supporting rod of the invention can be formed by a plurality of connected sections. One end of rear supporting rod 20 of the microphone is connected to earphone casing 1, its interconnecting portion forms an earphone and the plug-in pieces of microphone cord. A telescopic sliding connecting portion 18 and/or a sliding connecting portion 33 are/is formed between a front supporting rod 39 and the rear supporting rod 20 of the microphone. To have a certain degree of resistance during retraction of the connecting portions 18 and 33, a braking device for preventing sliding, such as the braking device of a telescopic antenna, can be utilized. Or the above-mentioned braking device can be utilized. The connecting portion 18 of front supporting rod 39 and the connecting portion 33 of rear supporting rod 20 can have a rotatable hinge 35. The rotatable hinge 35 can also use the above-mentioned connecting means. The fore end of front supporting rod 39 of the microphone is connected to a microphone casing 40. The ear hanger is connected with the rear supporting rod 20 of the microphone, or it can be connected to the outside of microphone casing 1 or other suitable places.

Figure 3B:
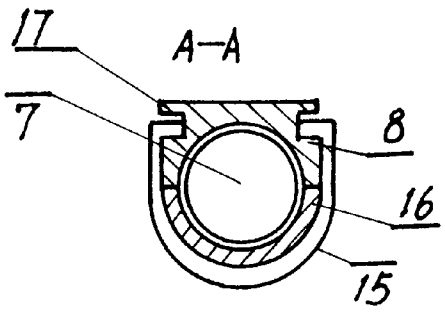
FIGS. 3A, 3B and 3C are the front sectional view, sectional view taken along A—A line, and sectional view taken along B—B line of earphone and microphone cord plag-in components of part A in an ear hanger.
Figure 3A:
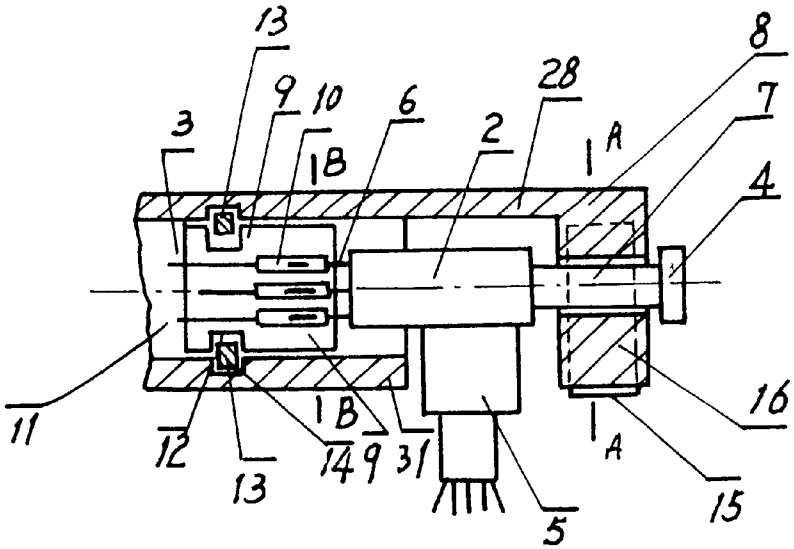
Figure 3C:
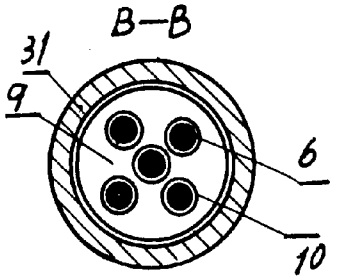

Partial sectional views of the earphone and microphone cord plug-in pieces of the ear transceiver are shown in FIGS. 3A, 3B and 3C.

FIGS. 3A, 3B and 3C are the front sectional view, sectional view taken along A—A line, sectional view taken along B—B line, respectively, of an earphone and microphone cord plug-in pieces of section A in FIG. 1.

Earphone and microphone cord plug-in pieces comprise a plug-in unit and a socket assembly, in which the plug-in unit comprises a plug 3, a plug base 2, and a plug fastener 4. The socket assembly comprises a socket sleeve 31, a socket base 8, and a socket 9.

Plug 3 and socket 9 are arranged in the socket sleeve 31 of a joining portion between rear supporting rod 20 and earphone casing 1. The fore end of plug 3 has a plurality of pins 6, and the earphone and the microphone cord 5 are leading out from the plug base 2. Socket 9 is mounted in socket sleeve 31 of the socket assembly, and plug 3 is also inserted into the socket sleeve 31. A plug fastener 4 is connected and fastened in a socket base 8. There is an interconnecting portion 28 between the socket sleeve 31 and the socket base 8. Interconnecting piece 28 is strip-shaped, allowing the earphone and microphone cord 5 of plug base 2 arranged therein to be rotatable, so that the various supporting rods of the front stand cause the rotation of microphone rear supporting 20 with the rotation of a gemel, so as to achieve the objective that the same earphone is wearable on both left and right ears. When the earphone is worn on left or right ear, through turning plug base 2, the earphone and the microphone cord 5 are kept to be always directing upwards or hanging down.

Moreover, the socket base 8 has an upper cap 16 and a dog 15. The upper cap 16 can be removed to facilitate the installation of plug 3. After plug 3 has been mounted, upper cap 16 is closed and dog 15 is chucked. Fixtures on both sides of dog 15 are chucked into the fixture slots 17 on both sides of the bottom of socket base 8. The middle part of plug fastener 4 is thinner than its two ends to form a slotted spindle 7. A hole is provided on the socket base 8, and slotted spindle 7 is chucked therein, i.e. socket base 8 forms a ledge and slotted spindle which match each other, thereby preventing the plug 3 from moving back and forth while being allowed to rotate within a certain range. Other types of assembly can also be employed for causing the rotation of plug 3 while allowing it to be removed/installed as well as allowing it to rotate with single degree of freedom but preventing it from back and forth movement. For example, the outer end of socket base 8 is closed, and the diameter of the middle part of the plug is set to be slightly larger than that of socket sleeve 31 and inner cavity of socket base 8, then the plug 3 and the plug fastener portion 4 are in the socket cavity on both ends; thus plug 3 and plug fastener portion 4 form an assembly performing one degree of freedom movement and having a cylindrical axle neck. Other method can also be employed for fastening and connecting upper cap 16 and socket base 8. For example, one end of upper cap 16 has a hinge joint, another end thereof has a chuck hook chucking a fixture slot on the socket base 8 or combining the upper cap 16 and dog 15 into an integral part. Fixtures are provided on upper cap 16, for directly chucking into a chucking recess 17 on both sides of the bottom of socket base 8 etc.

Socket 9 in the socket sleeve 31 has the same number of jacks 10 as the pins 6 of the plug 3, various electric wires 11 of the jacks 10 are connected to the circuit of microphone and earphone etc, and are connected with outer circuit via pins 6. On the inner wall of socket sleeve 31 is arranged a sleeve slot 14 for fastening the socket 9, while the socket 9 has a fixed slot 12, so that slots 14 and 12 tightly chuck socket 9 via an expandable clamp ring 13 to prevent it from moving back and forth while being allowed to rotate within a range, e.g., more than 180°, thereby realizing the object that the same earphone is wearable on both left, right ears. If an earphone wearable on only one ear is adopted, then plug 9 can be directly fixed in the socket sleeve 31, or it can be made as a fixed earphone lead. Since the microphone cord and earphone plug-in connecting mode is adopted, earphone and microphone cord can be easily replaced. In the foregoing, earphone and microphone cord are inserted into jacks 10 of socket 9 via pins 6 of plug 3, while the two can also be inverted, and is likewise feasible. Other electrical connecting means of rotational assembly with single degree of freedom, e.g. currently employed connecting means of earphone plug and socket etc.

Figure 4B:
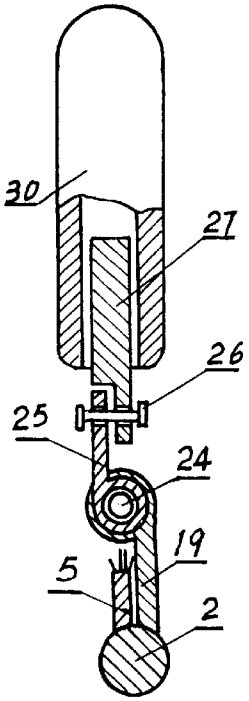
FIGS. 4A and 4B are a structural part sectioned view of another embodiment of ear transceiver and a left part sectioned view of a front stand of an ear hanger in the invention respectively.
Figure 4C:
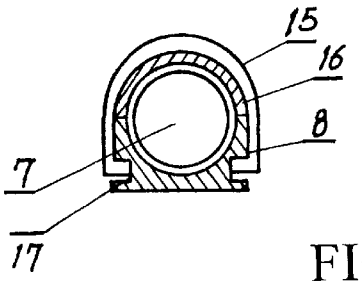
FIGS. 4D and 4C are a sectional view taken along A—A line, and a sectional view taken along B—B line separately.
Figure 4A:
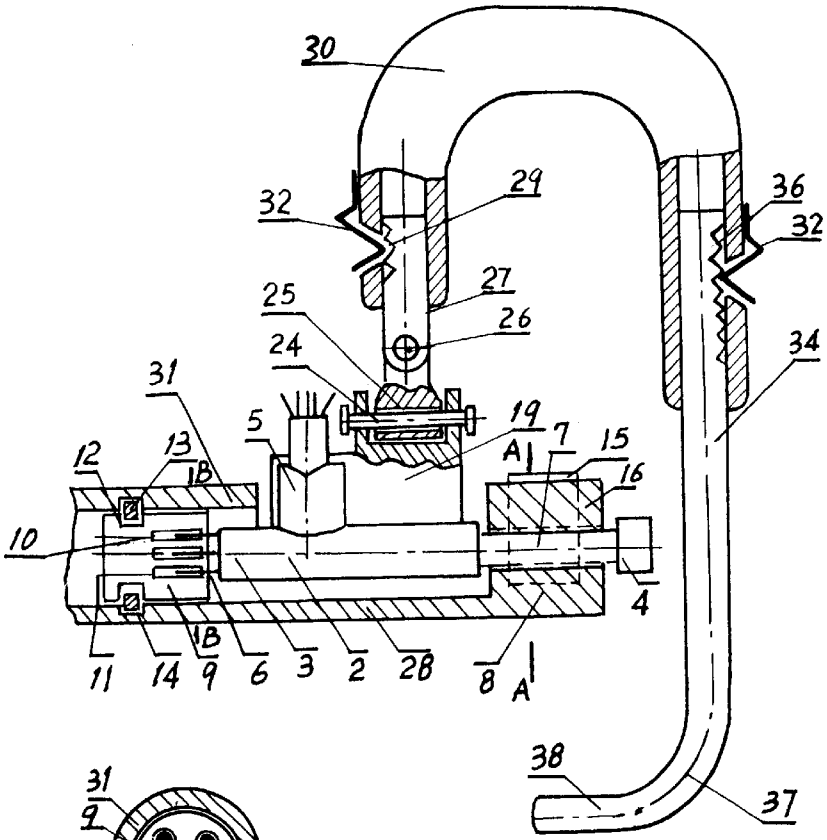
Figure 4D:
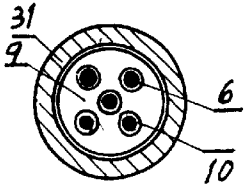

FIGS. 4A and 4B are the structural part sectioned views and the left part sectioned view of front stand of the ear hanger of another embodiment of the invention respectively. FIGS. 4D and 4C are the sectional view taken along A—A line and the sectional view taken along B—B line respectively. Same symbols in FIGS. 4 and 3 represent the same members, and descriptions thereof are omitted.

In contrast with FIG.3, it can be seen from the drawings that the unique characteristics of the embodiment is in that, over the plug base 2 on the earphone and microphone cord, provided are not only having earphone and microphone lead out 5 but also a plug supporting rod 19 connected to the ear hanger. The supporting rod 19 functions as the first supporting rod 23 of front stand. A connecting hole is provided on the upper end of plug supporting rod 19, and a second axle 24 penetrates through the connecting hole to be hinge-jointed with second supporting rod 25 of front stand. Thus the angle of rotation of supporting rod 19 relative to the ear hanger is enlarged. If the rotation angle of supporting rod 19 needs not to be enlarged, then a hinge of above-mentioned structure can be omitted, and supporting rod 19 can serve as the second supporting rod 25 of front stand on the ear hanger for connecting to the third supporting rod directly. The second axle 24 can be made as an extractable moving part, thus when replacing earphone and microphone cord, second axle 24 can be removed, and the ear hanger remains mounted on new earphone and microphone cord continuously.

Earphone and microphone lead-outs 5 are provided adjacent to supporting rod 19 of plug 3 on earphone and microphone cord, allowing supporting rod 19, earphone, and microphone lead outs 5 to rotate along with the plug base 2, thereby realizing the objective that the single and same earphone is wearable on both left and right ears. When both ears are wearing earphones, with the rotation of plug base, earphone and microphone cord 5 are allowed to always bypass the upper part of the ear upwards and hang down from the back of the ears.

Figure 5B:
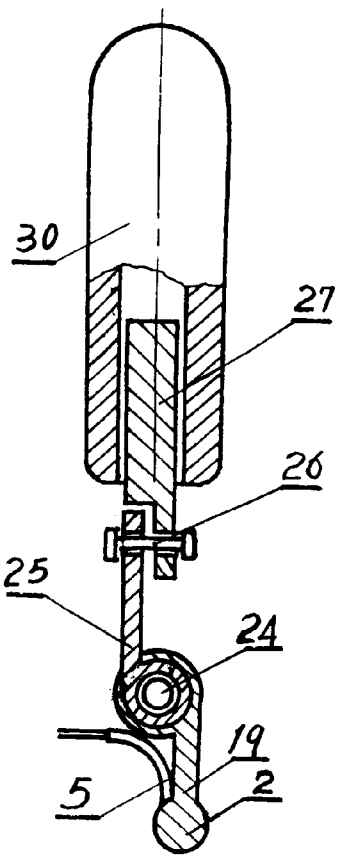
FIGS. 5A and 5B are a structural part sectioned view and a left part sectioned view of an ear transceiver of another embodiment in the invention respectively.
Figure 5A:
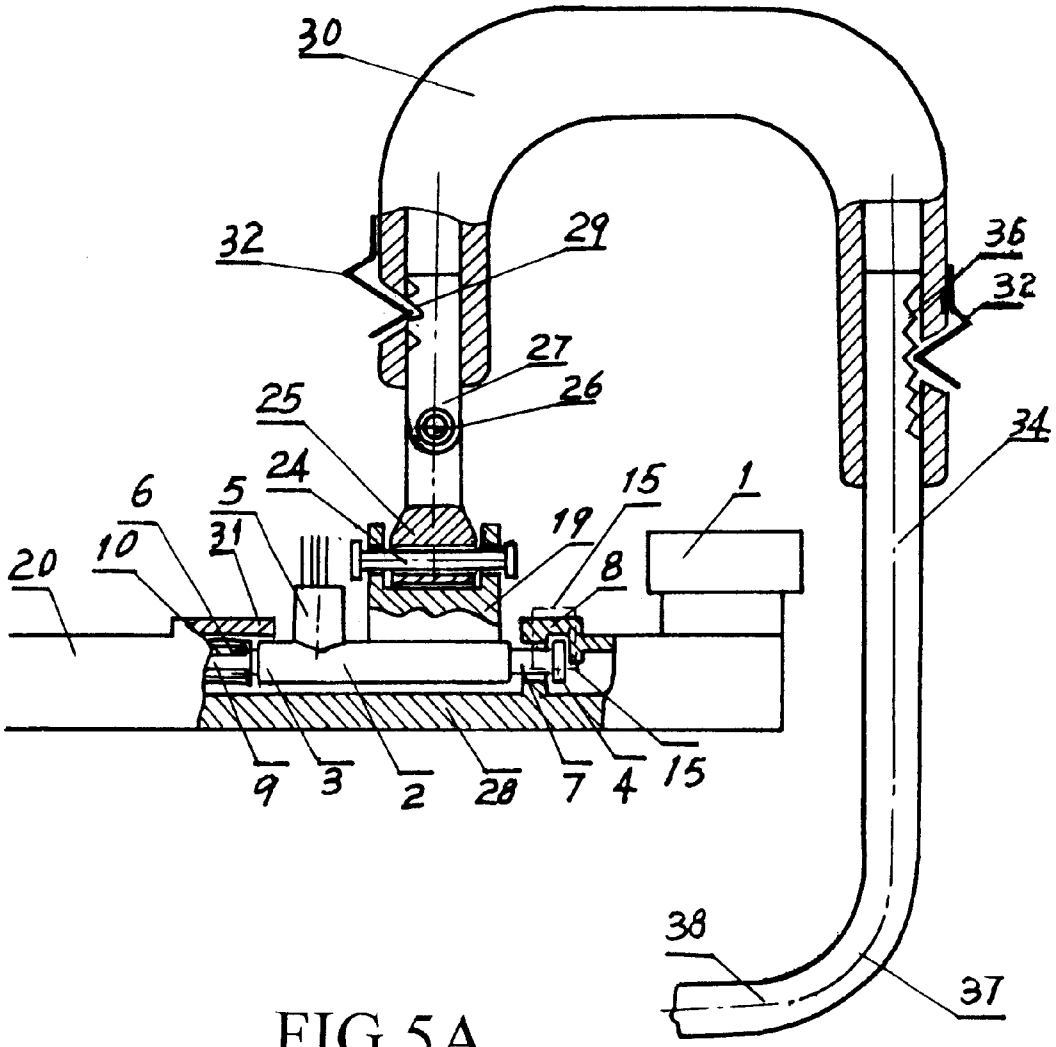

FIGS. 5A and 5B are a front partial sectional view and left partial sectional view of front stand on an ear hanger of still another embodiment of the invention respectively. In FIG.5, the symbols which are same with those in FIGS. 1, 4 represent the same components, therefore descriptions of the same are omitted.

In comparison with FIG. 1, it can be seen from FIG. 5 that the present embodiment is different in that earphone, microphone cords, and ear hanger joined into an integral unit are mounted on the rear supporting rod 20 of the microphone, while earphone and microphone lead plug and socket outside the earphone case 1 are removed.

Figure 6B:
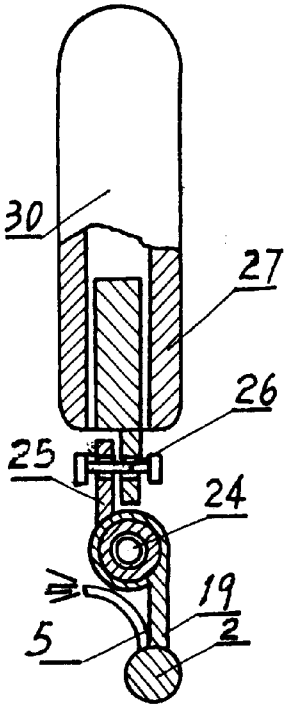
FIGS. 6A and 6B are a structural part sectioned view and a left part sectioned view of a front stand an ear hanger in an ear transceiver of another embodiment in the invention respectively.
Figure 6A:
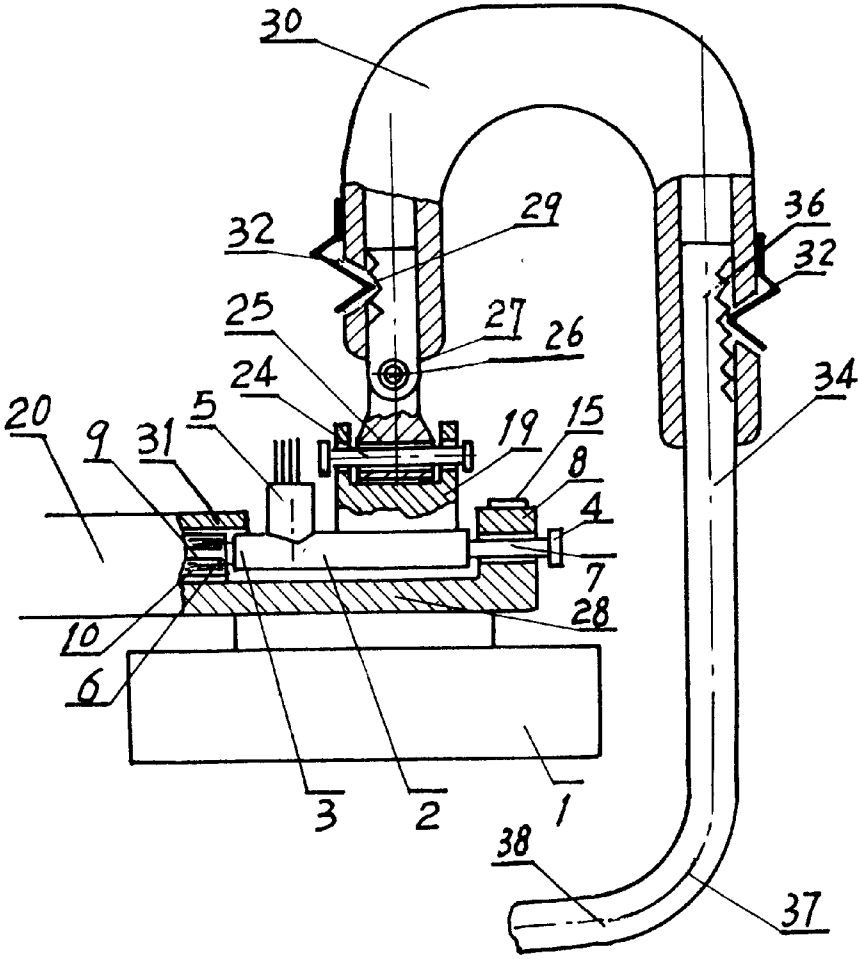

FIGS. 6A and 6B are a front partial sectional view and left partial sectional view of front stand on ear hanger of another embodiment in the invention respectively. In FIG. 6, the same symbols as in FIG. 1 represent the same parts, accordingly descriptions of the same are omitted.

Comparing with FIG. 3, it can be seen from FIG. 6 that the difference of the present embodiment is that earphone, microphone lead out/plug and ear hanger joined into an integral are installed outside the earphone casing 1, while the ear hanger on microphone rear stand is removed. This connection mode can also be used on an earphone having only an earphone casing without microphone stand and microphone casing.

The separated earphone, microphone cord plug, and ear hanger of the present invention can be respectively connected to positions of inside, outside, upper side, and lower side of microphone rear supporting rod 20, and the outside of earphone casing 1. The earphone, microphone lead-out plug and ear hanger joined into an integral can be connected, as an integral, to positions of inside, outside, upper side, lower side etc of microphone rear supporting rod 20, or other suitable places.

Figure 7:
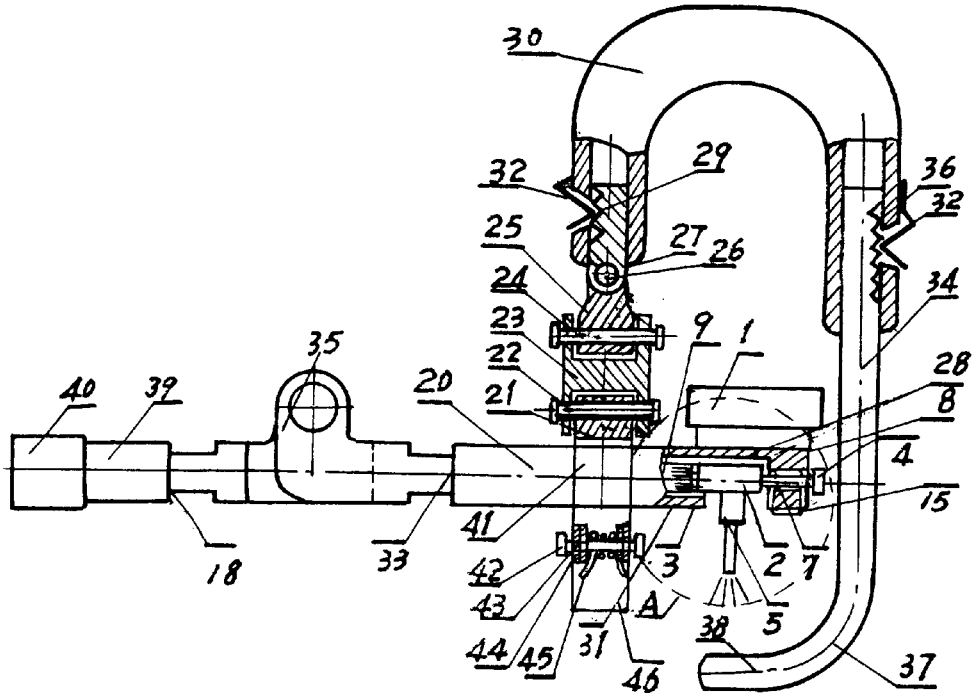
FIG. 7 is a structural part sectioned view of another embodiment of an ear transceiver with a clamper.
Figure 8:
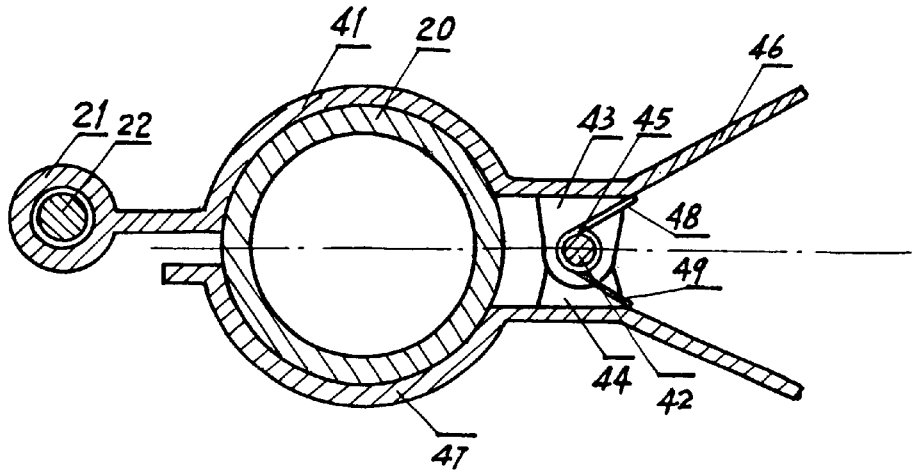
FIG. 8 is a left part sectioned view of an ear hanger damper shown in FIG. 1

FIG. 7 is a front partial sectional view of an embodiment of an ear transceiver with a clamper; FIG. 8 is a left partial sectional view of an ear hanger damper shown in FIG. 1. As shown in the drawings, an ear transceiver comprises: an ear hanger, and a microphone, an earphone, a microphone, and microphone lead-out plug-in pieces connected to both ends of microphone connecting rod.

In FIGS. 7 and 8, the same symbols as in FIGS. 1, 2 represent the same parts, and descriptions of the same are omitted.

Comparing with FIGS. 1 and 2, it can be been from FIGS. 7 and 8 that the present embodiment is different in that an ear hanger is gripped onto the rear supporting rod 20 of the microphone by two clamping frames 41, 47 of a clamper, rather than connecting to the connecting rod 20 of the microphone directly.

A clamper connecting means is used for connecting rear supporting rod 20 of the microphone with the ear hanger. The front end of clamper 41 is provided with a branching supporting rod 21 for connecting with the ear hanger. A connecting hole is provided on the branching supporting rod 21, connection is conducted by penetrating the first axle 22 through the hole to connect with connecting holes in two connecting pieces on first supporting rod 23 of front stand on the ear hanger. A rotatable hinge, i.e. an axle-sleeve structure, is formed.

Two clamping frames 41, 47 of the clamper are connected by the connecting stands 43, 44 on both sides via a axle 42 penetrating through an intermediate connecting hole. An expanding spring 45 sheathed outside the axle 42 is suppressed at the inside of levers 46, 47 via two semi-girders 48, 49, enabling the levers 46, 47 to expand. The two clamping frames 41, 47 are chucked with the rear supporting rod 20 of a microphone. When the ear hanger is required to move back and forth on the rear supporting rod 20 of the microphone, pressure can be exerted to the outer side of levers 46, 47 to release the two clamp frames 46, 47, resulting in the ear hanger to move back and forth or rotate on the rear supporting rod 20 of the microphone.

The clamper can also use other types of clamping mechanism, or the clamper may be changed to have a sleeve sheathing outside the rear supporting rod 20 of the microphone to form a sliding connecting means. With various types of braking devices, e.g. elastically compressed expansion or brigaette brakes via elastomers such as a helical spring or spring or spring reed etc, an elastic compressed friction brake, a lockpin, and a screw and a nut etc, the ear hanger is allowed to move or rotate on a connecting rod 20 of a microphone as required.

Figure 9:
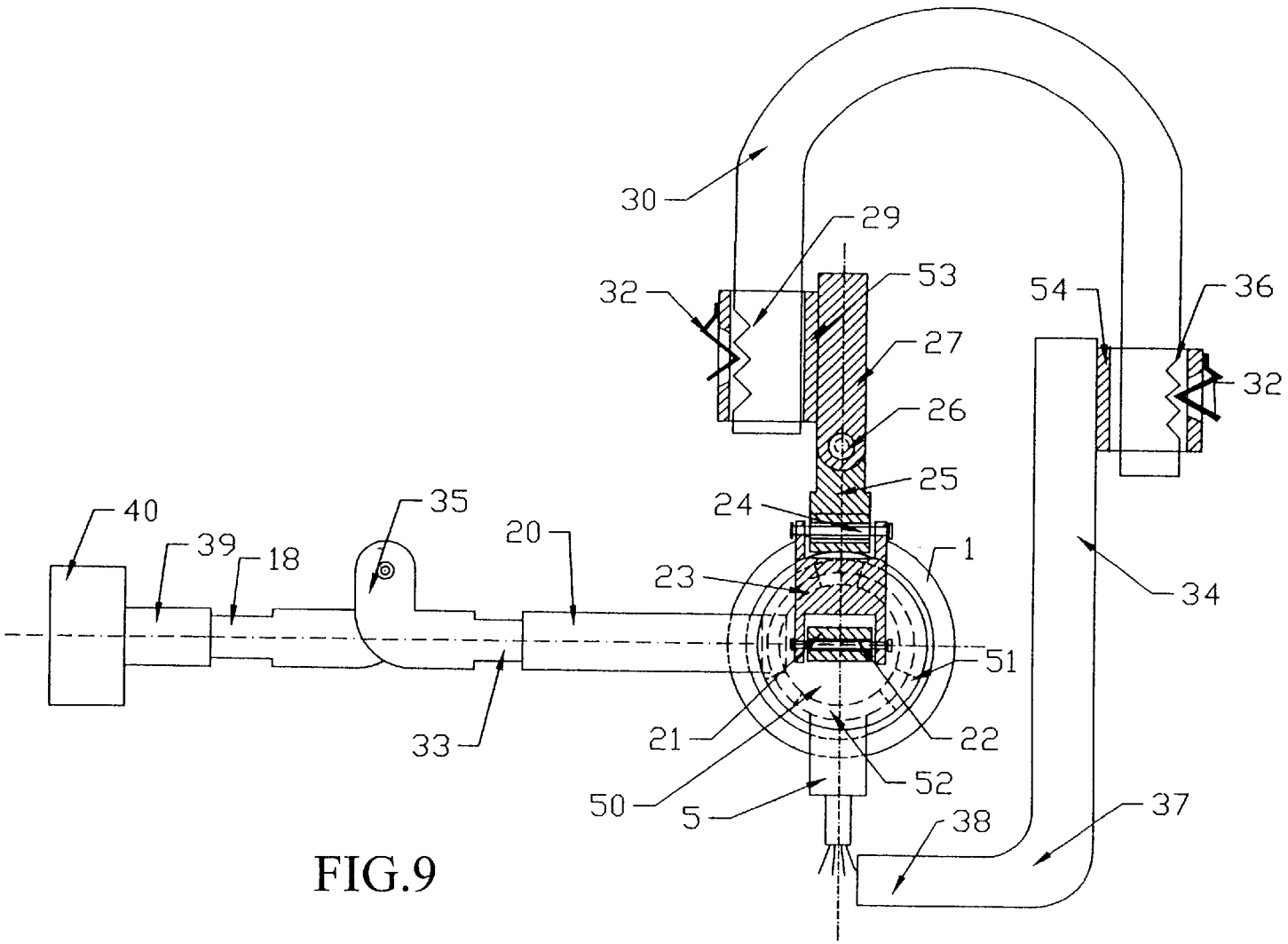
FIG. 9 is a part sectioned view of an ear hanger and a microphone employing a clamping cap connecting means in the invention.
Figure 10:
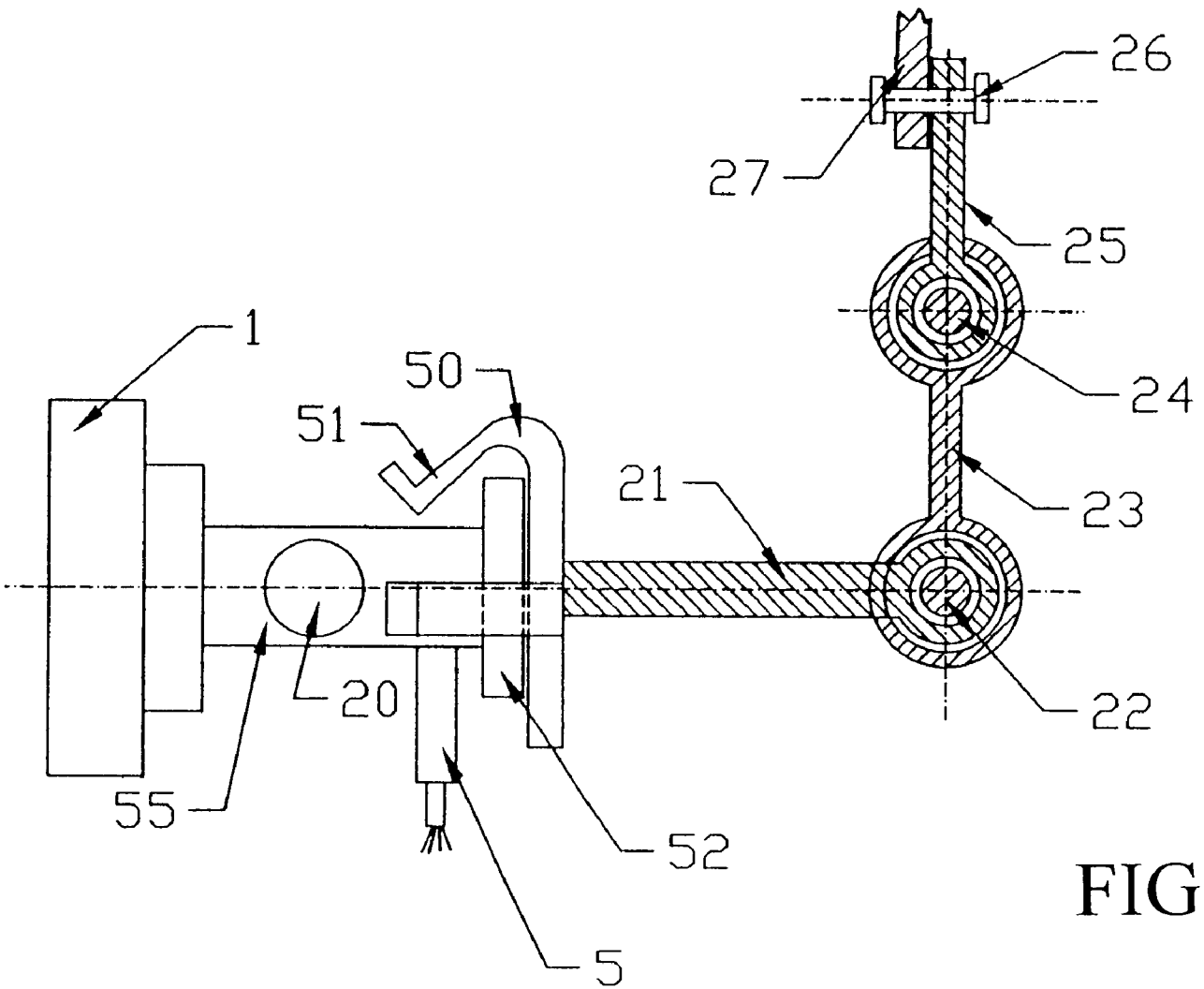
FIG. 10 is a left part sectioned view of an embodiment shown in FIG. 9.

In FIGS. 9, 10, the same symbols as those in FIGS. 1, 2 represent the same members, and descriptions of the same are omitted.

In comparison with FIGS. 1, 2, it can be seen from FIGS. 9, 10 that the present embodiment is different in that an ear hanger is gripped onto a connecting ring 52 of extension arm 55 on the earphone's back cap via two or multiple clamp frames 51 of clamping cap 50, rather than directly connected onto a rear supporting rod 20 of the microphone. A sleeve 53 is provided on the side face of another end of third supporting rod 27 of the front stand of the ear hanger, and the front end of supporting tube 30 is inserted into a pipe cavity at one end on sleeve 53, forming a telescopic sliding connecting means. Other types of sliding connecting means can also be used, for example., by inserting the other end of the third supporting rod 27 into a sliding connecting leg on the side face of supporting tube 30, and forming serrate edge 29 on the end of inserted supporting tube 30. And an opening and corrugated spring reed 32 is provided on the side wall of sleeve 53, so as to be suppressed on serrate edge 29. Other types of braking devices can also be used, e.g., an expansion or briquette brake and an elastic compressed friction brake etc., conducting elastic compression via an elastomer like a helical spring or spring reed.

Using a sliding connecting means and a braking device similar to that used for the third supporting rod 27 of front stand on an ear hanger and the supporting tube 30, a sleeve 54 is mounted on the side wall at one end of rear stand 34, and a rear end of supporting tube 30 is inserted into a cavity on one end of sleeve 54, so as to form a telescopic sliding connecting means. An serrate edge 36 is formed on the rear end of supporting tube 30, and an opening and a corrugated spring reed 32 are provided on the side wall of sleeve 54 for suppressing on serrate edge 36.

In the invention, the earphone is used as a supporting point of the ear transceiver and functions in combination with an car hanger. The earphone, when not in use, can be replaced by a ring having a similar outer diameter of the earphone.

In the foregoing, preferred embodiments of the invention have been described in detail by referring to various drawings, however the invention should not be considered to be limited to the above-mentioned embodiments. Those skilled in the art, through reading these embodiments, should have no difficulty in making various improvements, alterations, or replacements to the ear transceiver of the invention without departing from the conception and spirit of the present invention. The scope of the invention is defined by the attached claims.

INDUSTRIAL APPLICATION

Above-mentioned multiple embodiments provided by the invention allows an ear transceiver to be suitable for the ears of various users, adapt to wearing of left, right cars convenient in replacement of earphone and microphone lead-out, and the distance to be adjustable between a microphone and a mouth.

What is claimed is:

1. An ear transceiver device comprising:

a transceiver mounted on a microphone supporting rod;

an ear hanger connected to the transceiver for hanging the transceiver on ear(s) of a user; and an electrical connecting means connected to the transceiver;

wherein said ear hanger comprises an inverted-U-shaped supporting member for hanging on upper end of the user's ear, a front stand coupled with one end of the inverted-U-shaped supporting member for being positioned at front part of the user's ear, and a rear stand coupled with the other end of the inverted-U-shaped supporting member for being positioned at rear part of the user's ear with one end of the rear stand being bent to a curved shape to accommodate a lower end of the user's ear;

wherein said front stand is pivotally connected with said microphone supporting rod, so that said front stand can rotate around an axis substantially parallel with a longitudinal axis of the microphone supporting rod;

wherein one end of the front stand is coupled with one end of the inverted-U-shaped member and one end of the rear stand is coupled with the other end of the inverted-U-shaped member in such a manner that said end of the front stand and said end of the rear stand are movable with respect to said inverted-U-shaped member so as to accommodate ears of different size; and wherein the electrical connecting means for electrically connecting with the transceiver is able to rotate.

2. The device according to claim 1, wherein said transceiver comprises a microphone and an earphone.

3. The device according to claim 1, wherein said microphone supporting rod has more than one interconnected sections with each section being slidable and rotatable with respect to one another.

4. The device according to claim 1, wherein said front stand comprises a first supporting rod and a second supporting rod, and one end of the first supporting rod is hinge-jointed with the microphone supporting rod forming a first hinge, the other end of the first supporting rod is hinge-jointed with the second supporting rod forming a second hinge, axles of the first and second hinges are substantially parallel with each other.

5. The device according to claim 1, wherein said front stand further comprises a third supporting rod, the third supporting rod is hinge-jointed with the second supporting rod forming a third hinge, an axle of the third hinge is substantially perpendicular to the axles of the first and second hinges.

6. The device according to claim 1, wherein said inverted-U-shaped supporting member comprises a tubular pipe, sliding connections between said front and rear stands and said inverted-U-shaped supporting member are realized through sliding contact between the ends of the front and rear stands and an inner wall of the tubular pipe, said front and rear stands have serrate edges thereon, an opening and a corrugated spring reed are provided on said tubular pipe, wherein the corrugated spring reed engages with the serrate edges allowing to change inserting depth of the front and rear stands into the tubular pipe.

7. The device according to claim 1, wherein the electrical connecting means is a plug-in piece comprising a plug-in portion and a socket portion and is provided at location between the microphone supporting rod and an earphone casing, and the microphone supporting rod and the earphone casing are connected to each other.

8. The device according to claim 7, wherein a socket is mounted at a joint portion between said microphone supporting rod and the earphone casing.

9. The device according to claim 8, wherein a microphone and an earphone separately provided on two ends of the microphone supporting rod are hinge-jointed with the ear hanger via a plug supporting rod provided on a plug of the plug-in portion.

10. The device according to claim 1, wherein connection between said car hanger and said microphone supporting rod is realized by using a clamping connecting means.

* * * * *